US008414268B2

(12) United States Patent
Aiello

(10) Patent No.: US 8,414,268 B2
(45) Date of Patent: Apr. 9, 2013

(54) ROTOR WITH ONE-SIDED LOAD AND LOCK SLOTS

(75) Inventor: Nicholas D Aiello, New Haven, CT (US)

(73) Assignee: United Technologies Corporation, Hartford, CT (US)

( * ) Notice: Subject to any disclaimer, the term of this patent is extended or adjusted under 35 U.S.C. 154(b) by 638 days.

(21) Appl. No.: 12/621,536

(22) Filed: Nov. 19, 2009

(65) Prior Publication Data

US 2011/0116933 A1 May 19, 2011

(51) Int. Cl.
*F01D 5/32* (2006.01)

(52) U.S. Cl.
USPC ..... 416/215; 416/216

(58) Field of Classification Search ..... 415/215, 415/216, 244 A, 248; 29/889.21; 416/215, 416/216, 244 A, 248
See application file for complete search history.

(56) References Cited

U.S. PATENT DOCUMENTS

| | | | | |
|---|---|---|---|---|
| 1,466,324 | A * | 8/1923 | Wilkinson | 416/215 |
| 2,393,447 | A * | 1/1946 | Allen | 416/216 |
| 4,451,204 | A * | 5/1984 | Pask | 416/215 |
| 4,460,315 | A | 7/1984 | Tseng et al. | |
| 4,818,182 | A * | 4/1989 | Bouru | 416/215 |
| 4,907,944 | A * | 3/1990 | Kroger et al. | 415/65 |
| 5,522,706 | A * | 6/1996 | Mannava et al. | 416/215 |
| 6,135,717 | A | 10/2000 | Sokol et al. | |
| 6,270,318 | B1 | 8/2001 | Shah et al. | |
| 6,398,500 | B2 | 6/2002 | Pedersen et al. | |
| 6,431,836 | B2 * | 8/2002 | Zimmermann | 416/220 R |
| 6,435,830 | B1 | 8/2002 | Allen et al. | |
| 6,447,253 | B2 | 9/2002 | Tempere | |
| 6,477,916 | B2 * | 11/2002 | Knorowski et al. | 416/144 |
| 6,638,006 | B2 * | 10/2003 | Selby | 415/9 |
| 6,796,769 | B2 | 9/2004 | Moroso | |
| 7,175,391 | B2 | 2/2007 | Chlus et al. | |
| 7,216,694 | B2 | 5/2007 | Otero et al. | |
| 7,441,585 | B2 | 10/2008 | Otero et al. | |
| 7,467,924 | B2 | 12/2008 | Charbonneau et al. | |
| 2001/0055527 | A1 * | 12/2001 | Yvon Goga et al. | 416/215 |
| 2006/0083621 | A1 * | 4/2006 | Klingels | 416/215 |

* cited by examiner

*Primary Examiner* — Edward Look
*Assistant Examiner* — Liam McDowell
(74) *Attorney, Agent, or Firm* — Carlson, Gaskey & Olds, PC

(57) ABSTRACT

A rotor for a turbine engine has a pair of spaced rails that extend around a cylindrical surface space. The rails define a space for receiving blades and locks. A plurality of slots are formed in one of the rails, with an opposed surface on an opposed rail not being formed with a slot. The slots are utilized to move at least one of the locks and the blades into the space.

3 Claims, 4 Drawing Sheets

ROTOR WITH ONE-SIDED LOAD AND LOCK SLOTS

BACKGROUND OF THE INVENTION

This application relates to a tangential compressor or turbine rotor wherein slots are formed on only one of the two rails in the rotor.

Gas turbine engines are known, and typically include a compressor which compresses air and delivers it downstream into a combustion section. The compressed air is mixed with fuel and combusted. Products of this combustion pass downstream through a turbine. The compressor and turbine include rotors upon which mount a plurality of removable blades.

Typically, the blades are mounted into a tangential rotor by moving into load slots that are formed in the two opposed rails in the rotor, and at circumferentially spaced locations. Blades have their relatively wide roots moved into the load slots, then they are slid into a mount space between the rails, at locations where there are no load slots. The blades are circumferentially moved until they fill the entire space. In addition, locks are positioned at several circumferentially spaced locations between the blades to take up remaining space and inhibit the blades from moving circumferentially relative to the rotor.

In the prior art, slots for receiving the locks, and the load slots are formed in both of the rails.

SUMMARY OF THE INVENTION

A tangential rotor for a turbine engine has a pair of spaced rails that extend around a cylindrical surface space. The rails contain defined spaces for receiving blades and locks. A plurality of slots are formed in one of the rails, with an opposed surface on an opposed rail not being formed with a slot. The slots are utilized to move at least one of the locks and the blades into the space.

These and other features of the present invention can be best understood from the following specification and drawings, the following of which is a brief description.

DETAILED DESCRIPTION OF THE PREFERRED EMBODIMENTS

Figure 1:
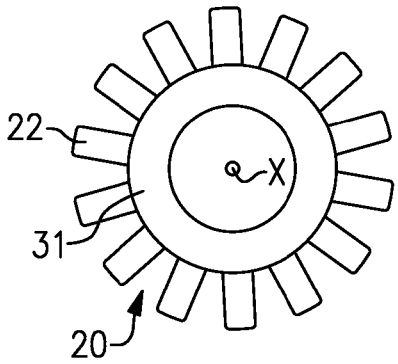
FIG. 1 shows the mounting of a blade within a turbine rotor.

FIG. 1 schematically shows a turbine rotor 20 for use in a gas turbine engine. The rotor 20 incorporates a rotor hub 31, and a plurality of blades 22 spaced about the circumference of the rotor hub 31. As known, the rotor hub 31 is centered for rotation about a central axis X. While the invention will be disclosed with reference to a turbine rotor, it will have application in a compressor rotor also.

Figure 2B:
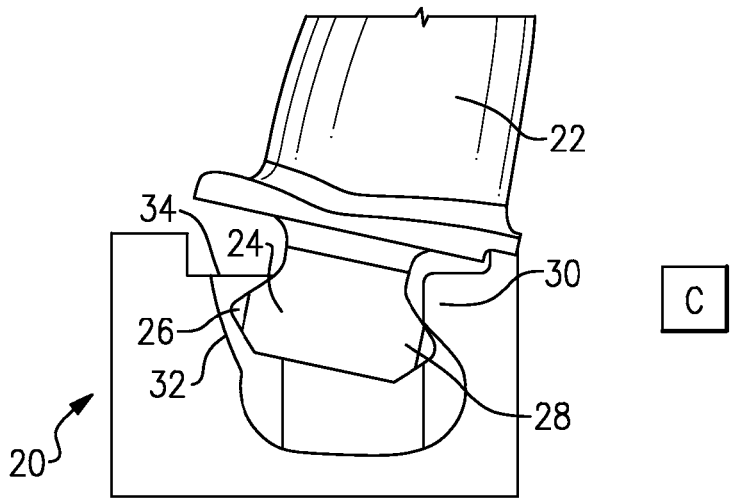
FIG. 2B shows a portion of the turbine rotor structure, and a blade insertion step.
Figure 2A:
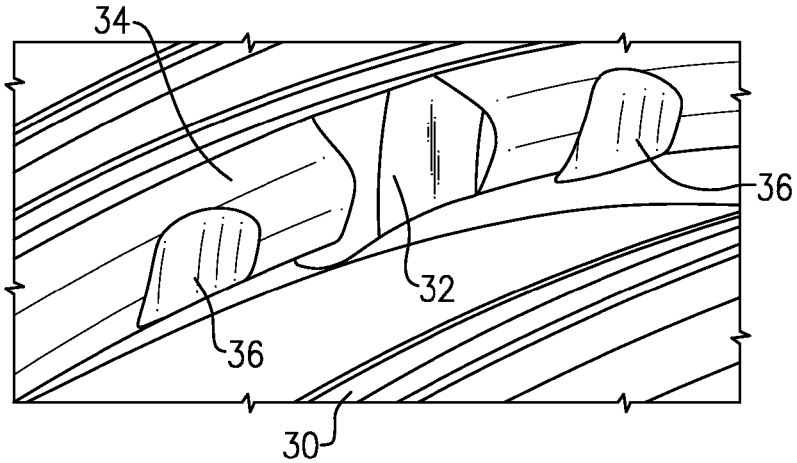
FIG. 2A shows a portion of the turbine rotor structure.

As shown in FIGS. 2A and 2B, a blade 22 is being mounted between rear rail 34 and forward rail 30, and through a load slot 32. The rear rail 34 and forward rail 30 together make up a pair of spaced rails. The load slot 32 is formed in the "cold side" rear rail 34, and is not formed in the "hot side" forward rail 30. The "hot side" forward rail 30 may face upstream toward a combustion section C when the rotor 20 is mounted within a gas turbine engine. While the "hot side" will typically face the combustion section, in certain applications, and at certain turbine stages, it is possible for the opposed "downstream" side of the turbine to be the hot side. Further, when the features of this application are applied to a compressor rotor, the hot side may also be facing toward the combustion section, or away, depending on the particular application.

As shown, the blade has a root section 24 having a forward ear 28, which is received under the forward rail 30, and a rear ear 26, which moves through the load slot 32.

As shown in FIG. 2B, the load slot 32 is formed in the rear rail 34, and there is no corresponding slot in the forward rail 30. In addition, the rear rail 34 is formed with lock slots 36, while the forward rail 30 does not have any such lock slots 36, as shown in FIG. 2A.

Figure 3:
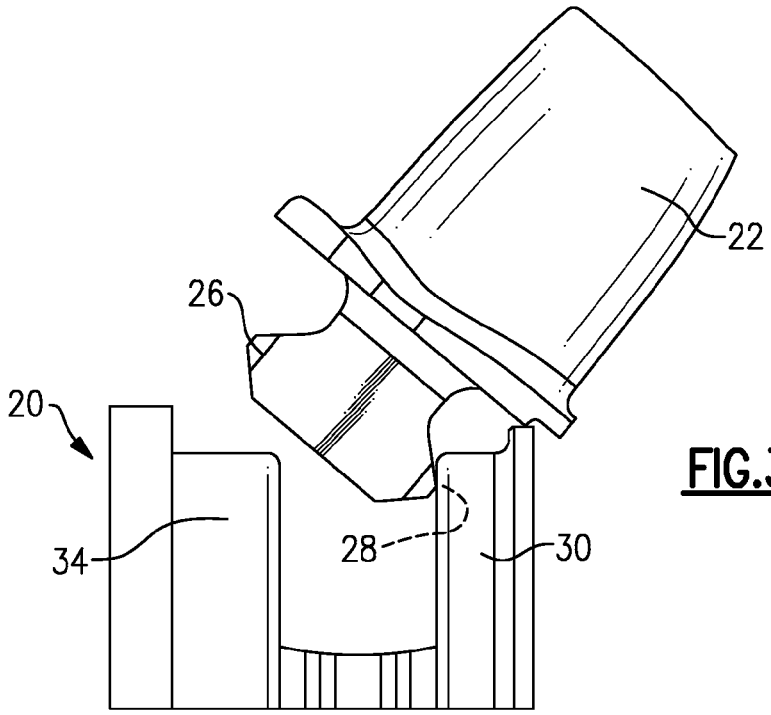
FIG. 3 shows a subsequent step.

As shown in FIGS. 2B and 3, when initially mounting a blade 22 within the rotor hub 31, the forward ear 28 is initially hooked under the forward rail 30. At the same time, the rear ear 26 is not yet moved through the load slot 32.

Figure 4:
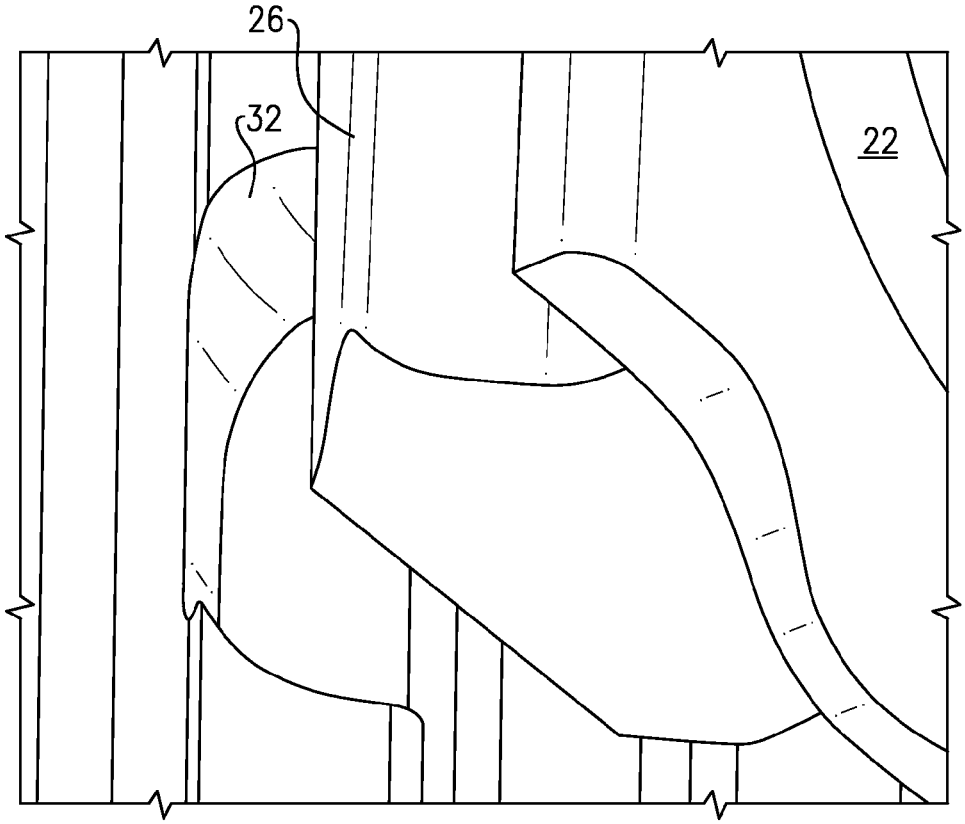
FIG. 4 shows a subsequent step.

As shown in FIG. 4, the rear ear 26 is now being moved toward the load slot 32. The blade 22 is now rotated into the load slot 32. Then, the blade 22 can be moved circumferentially, with the ears 26 and 28 remaining underneath portions of the forward rail 30 and rear rail 34, such that the blades 22 can be aligned and positioned across the entire circumference of the rotor 20 (see FIGS. 1 and 5). In applications, there may be two load slots 32 spaced by 180° about the circumference of the rotor hub 31. Essentially, the forward rail 30 and rear rail 34 define a space to receive and mount the blades 22.

Figure 5:
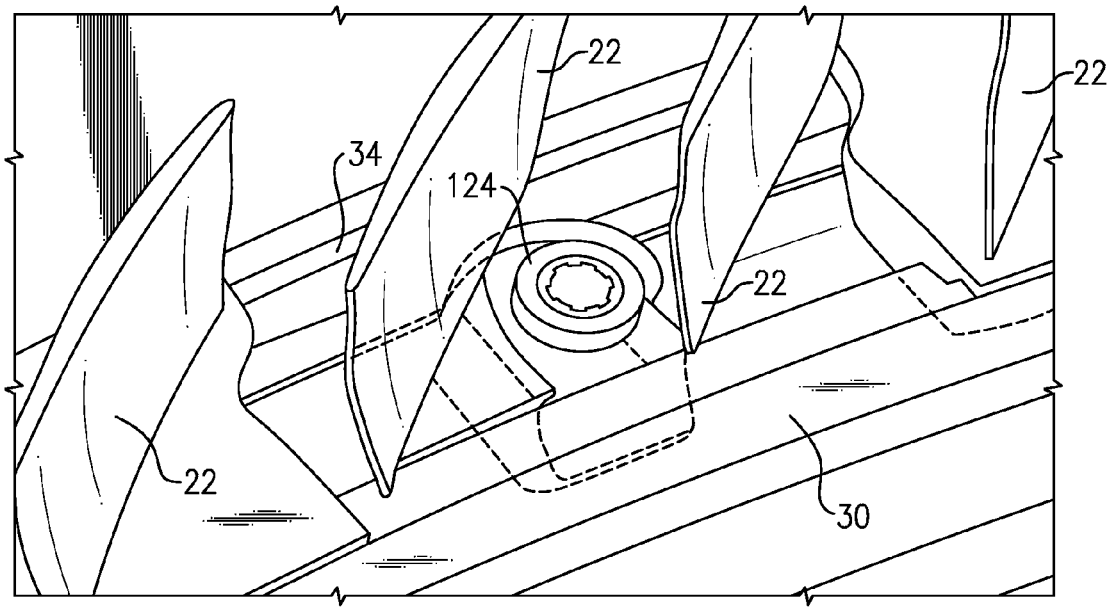
FIG. 5 shows a feature of the lock members.

FIG. 5 shows another detail, wherein blades 22 have been mounted between the forward rail 30 and rear rail 34. In addition, other blades 22 are shown, which have a space to surround a lock member 124.

Lock members 124 are typically positioned on each side of a pair of blades 22 which sit on either side of a load slot 32 when the rotor 20 is fully assembled with blades 22. In addition, other locks 124 are provided at circumferentially spaced locations. In one example rotor, there are a total of eight locks, spaced evenly about the circumference of the rotor, but with two sets of locks secured on each side of a load slot 32.

Figure 6:
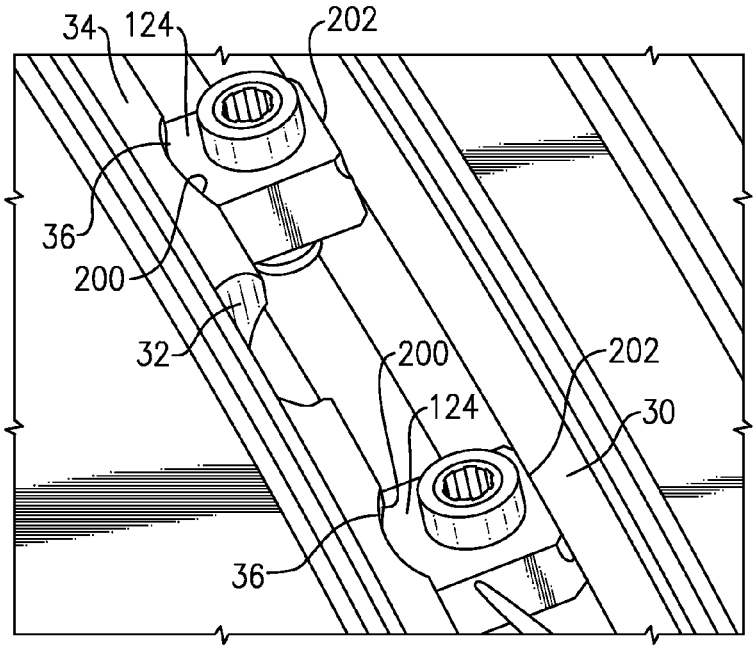
FIG. 6 shows another feature of the lock members.

As shown in FIG. 6, the locks 124 are received with a curved side 200 sitting in the lock slot 36, and a relatively flat side 202 facing the forward rail 30.

Figure 7:
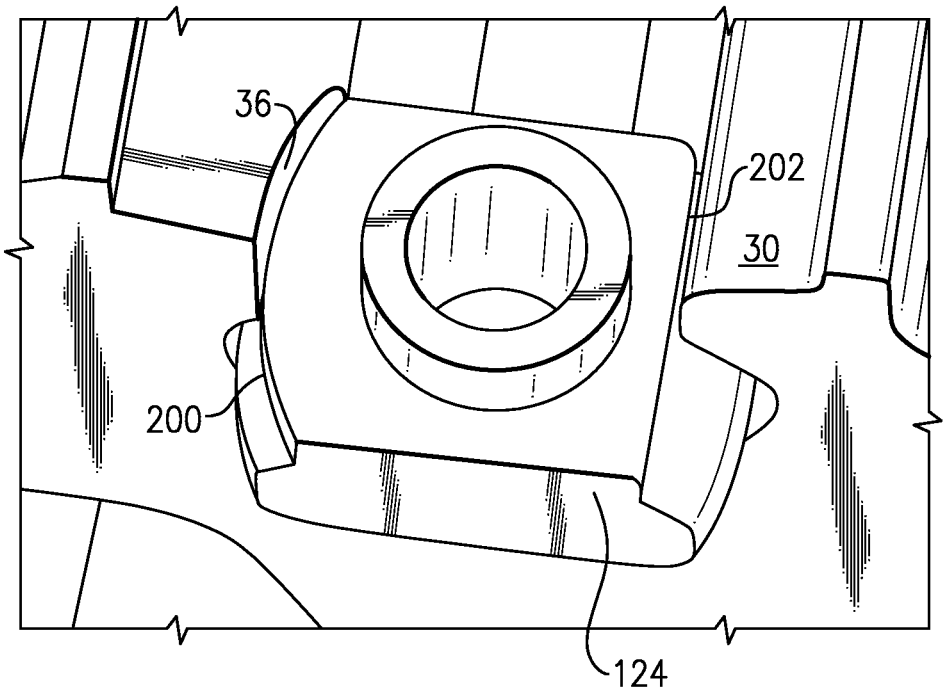
FIG. 7 shows another detail of the lock member.

As shown in FIG. 7, the flat side 202 of the lock member 124 will sit against the flat surface of the forward rail 30. The curved or barrel-shaped side 200 is formed on the opposed side of the lock 124 to sit within the lock slot 36.

Figure 8:
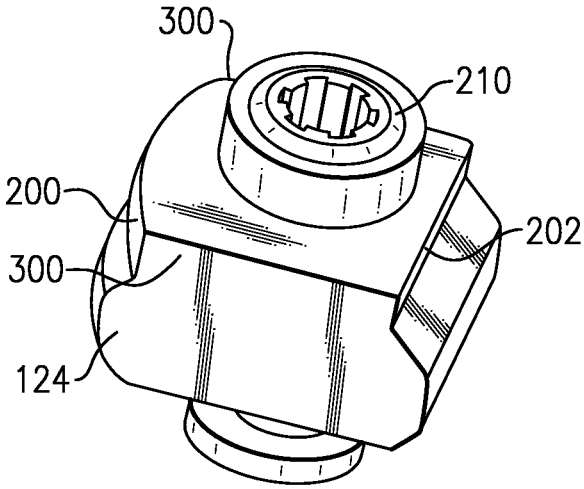
FIG. 8 is a further view of a lock member.

FIG. 8 shows the lock 124 having a flat side 202, the barrel side 200, and receiving a lock pin, or set screw 210 which is tightened to secure the lock 124 within the rotor hub 31 once the rotor 20 is fully assembled. As shown, the barrel side 200 is on one side of the lock 124, with the relatively flat side 202 on the opposite side. Flat side walls 300 extend between the barrel surface 200 and the flat surface 202.

While the disclosed embodiment incorporates both blade and lock slots, rotors coming within the scope of this application could use only one of the two, with the other being provided with the prior art dual-sided slots.

Although embodiments of this invention have been disclosed, a worker of ordinary skill in this art would recognize that certain modifications would come within the scope of this invention. For that reason, the following claims should be studied to determine the true scope and content of this invention.

What is claimed is:

1. A rotor for a turbine engine comprising:

a pair of spaced rails, said spaced rails extending around a cylindrical surface to define a rotor hub, and said rails defining a space for receiving blades and locks;

a plurality of single slots formed in one of said rails, with an opposed surface on an opposed rail not being formed with a slot, and said single slots being utilized to move at least one of said locks and said blades into said space;

said single slots are blade slots and said blades having ears extending outwardly in opposed axial directions, with said ears being received radially inwardly of said rails, and with said single slots being utilized to allow one of said ears to be hooked under said opposed rail, with the other of said ears moving through one of said single slots;

said rotor has a hot side rail when mounted in the turbine engine, and a cold side rail, and said single slots being formed in said cold side rail; and said hot side rail faces a combustion section when the rotor is mounted in the turbine engine.

2. A rotor for a turbine engine comprising:

a pair of spaced rails, said spaced rails extending around a cylindrical surface to define a rotor hub, and said rails defining a space for receiving blades and locks;

a plurality of blade slots and lock slots formed in one of said rails, with an opposed surface on an opposed rail not being formed with a slot, and said lock slots being utilized to move said locks and said blade slots being utilized to move said blades into said space;

said locks including a curved surface facing a curved surface of said lock slots, and an opposed relatively flat surface facing said opposed rail;

said blades moved into said space through said blade slots and then moved circumferentially to be adjacent to other blades;

said rotor having a hot side rail when mounted in the turbine engine, and a cold side rail, and said blade slots and said lock slots being formed in said cold side rail;

said blades having ears extending outwardly in opposed axial directions, with said ears being received radially inwardly of said rails, and with said single slots being utilized to allow one of said ears to be hooked under said hot side rail, with the other of said ears moving through one of said blade slots; and said hot side rail faces a combustion section when the rotor is mounted in the turbine engine.

3. The rotor as set forth in claim 2, wherein said rotor is a compressor section rotor.

* * * * *